US007023405B2

(12) United States Patent
Awamoto et al.

(10) Patent No.: US 7,023,405 B2
(45) Date of Patent: Apr. 4, 2006

(54) METHOD AND DEVICE FOR DRIVING PLASMA DISPLAY PANEL

(75) Inventors: Kenji Awamoto, Kawasaki (JP); Seiichi Iwasa, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 375 days.

(21) Appl. No.: 10/459,610

(22) Filed: Jun. 12, 2003

(65) Prior Publication Data

US 2004/0001035 A1 Jan. 1, 2004

(30) Foreign Application Priority Data

Jun. 28, 2002 (JP) ..... 2002-190626

(51) Int. Cl.
*G09G 3/28* (2006.01)

(52) U.S. Cl. ..... 345/60; 345/61; 345/62; 345/63; 345/64; 345/66; 345/68; 345/69

(58) Field of Classification Search ..... 345/60–69, 345/211, 204; 315/169.3, 169.4, 169.2
See application file for complete search history.

(56) References Cited

U.S. PATENT DOCUMENTS 3,886,404 A * 5/1975 Kurahashi et al. ..... 345/67
3,953,762 A * 4/1976 Iwakawa et al. ..... 345/69
4,180,762 A * 12/1979 Weber ..... 315/169.4
6,597,120 B1 * 7/2003 Schemerhorn et al. ... 315/169.3
6,753,833 B1 * 6/2004 Seo et al. ..... 345/60
6,784,858 B1 * 8/2004 Awamoto ..... 345/60
6,822,644 B1 * 11/2004 Awamoto et al. ..... 345/211
2001/0033255 A1 * 10/2001 Otsuka et al. ..... 345/60
2002/0054001 A1 * 5/2002 Awamoto ..... 345/60
2002/0105484 A1 * 8/2002 Shiizaki et al. ..... 345/60
2004/0075397 A1 * 4/2004 Tessier ..... 315/169.3
2004/0095294 A1 * 5/2004 Yamada ..... 345/60

FOREIGN PATENT DOCUMENTS

JP 2003-029700 1/2003

* cited by examiner

*Primary Examiner*—Vijay Shankar
*Assistant Examiner*—Prabodh Dharia
(74) *Attorney, Agent, or Firm*—Staas & Halsey LLP

(57) ABSTRACT

A plasma display device having display electrode pairs and providing improved luminance and light emission efficiency of display discharges with reduced variations of the luminance and light emission efficiency thereof resulting from variations of a display load. A discharge is generated by applying an offset drive voltage that is higher than a sustain voltage applied to the display electrode pair, and applying the sustain voltage for a constant period after dropping the applied voltage from an offset drive voltage to the sustain voltage after generating the display discharge. The drive output state is set to a low impedance state at least during a time period from the start of applying the offset drive voltage until the applied voltage drops to the sustain voltage.

9 Claims, 11 Drawing Sheets

METHOD AND DEVICE FOR DRIVING PLASMA DISPLAY PANEL

BACKGROUND OF THE INVENTION

1. Field of the Invention

The present invention relates to a method and device for driving a plasma display panel (PDP).

2. Description of the Prior Art

It is desired for a display device utilizing a PDP to realize a brighter display with lower electric power, i.e., to improve light emission efficiency. It is more preferable industrially to devise a drive pulse waveform for improving light emission efficiency rather than changing a panel structure including properties of fluorescent materials and composition of a discharge gas.

In a display using an AC type PDP, an addressing process is performed so as to control wall charge quantity of each cell of a screen in a binary manner in accordance with display data, and then a sustaining process is performed in which a sustain pulse is applied to all cells at one time. In the addressing process, it is decided whether the cell is lighted or not. In the sustaining process, light emission quantity is determined.

In the conventional driving method, during a display period for the sustaining process, a sustain pulse having a simple rectangular waveform is applied to a pair of display electrodes alternately. In other words, first and second display electrodes are biased to a predetermined potential (a sustain potential Vs) temporarily and alternately. In this way, a pulse train having alternating polarities is added between electrodes of the display electrode pair (i.e., to an XY-interelectrode). Responding to the application of the first sustain pulse to all cells, display discharge is generated in the cell in which a predetermined quantity of wall charge has been generated in the just previous addressing process. At that time, a fluorescent material in the cell is excited by ultraviolet rays emitted by a discharge gas and emits light. The light emission due to the display discharge is called "lighting". When the discharge is generated, the wall charge on a dielectric layer is once erased, and reform of wall charge is started quickly. The polarity of the reformed wall charge is opposite to the previous one. Along with the reform of the wall charge, cell voltage at the XY-interelectrode drops so that the display discharge is finished. The finish of discharge means that discharge current flowing in the display electrode becomes substantially zero. When a second sustain pulse (a sustaining voltage) is applied, since the polarity of the sustaining voltage is the same as the polarity of the wall voltage at that time, the wall voltage is added to the sustaining voltage. Therefore, the cell voltage increases, and display discharge is generated again. After that, display discharge is generated by each application of the sustain pulse similarly. In general, application period of the sustain pulse is approximately a few microseconds, so that the light emission is viewed continuously.

For the application of the sustain pulse, a pulse circuit is used that has a push-pull structure with a combination of switching elements (usually, field effect transistors: FETs). The switching elements are arranged between each display electrode and a bias power source terminal, as well as between each display electrode and the ground terminal (GND). Each of the switching elements is turned on and off so that a potential of each display electrode is determined. However, in the control of the pulse circuit, a dead time is provided in which both switching elements are turned off in switching the potential. This is for preventing the bias power source terminal and the ground terminal from making short circuit and breaking down the switching element. During the dead time, each display electrode is separated from the driving circuit electrically. Therefore, just before the leading edge and the trailing edge of the sustain pulse in which a potential of each display electrode changes, the output terminal of the driving circuit becomes high impedance to the display electrode, so that current is suppressed between the display electrode and the driving circuit.

In the conventional driving method of applying a sustain pulse having a simple rectangular waveform as explained above, amplitude of the sustain pulse is increased within an allowable range so that intensity of the display discharge is increased, thereby light emission luminance is raised. However, if the luminance is made to rise, power consumption is increased and the light emission efficiency drops.

SUMMARY OF THE INVENTION

An object of the present invention is to improve luminance and light emission efficiency in display discharge, and to reduce variations of the luminance and the light emission efficiency due to variation of display load.

According to one aspect of the present invention, for a sustaining process in which a voltage pulse train is applied to a display electrode pair so that display discharge is generated plural times in accordance with luminance of image to be displayed, a driving step of one pulse for generating display discharge one time includes the steps of generating display discharge by applying an offset drive voltage that is a sustain voltage plus an auxiliary voltage having the same polarity to the display electrode pair, and applying the sustain voltage for a constant period after dropping the applied voltage from the offset drive voltage to the sustain voltage after generating the display discharge. In addition, a conductive connection state between a power source for supplying an application voltage and the display electrode is made a low impedance state that enables current supply from the power source to the display electrode pair at least from the application start of the offset drive voltage until the applied voltage drops to the sustain voltage.

By applying an offset drive voltage that is higher than the sustain voltage, compared with the case where the sustain voltage is applied, strong display discharge is generated so that light emission luminance is raised. By dropping the applied voltage from the offset drive voltage to the sustain voltage, compared with just after start of the discharge, discharge current at the time when contribution to the light emission is small is suppressed, so that the light emission efficiency is improved compared with the case where the offset drive voltage is applied continuously. Reform of the wall charge depends mainly on the applied voltage after the display discharge is finished. Therefore, even if the applied voltage at start of discharge is raised so that the discharge intensity is increased, the state of the reformed wall charge can be an appropriate state in which display discharge can be repeated by dropping the applied voltage after the discharge starts.

In addition, from start of application of the offset drive voltage until the applied voltage drops to the sustain voltage, in a period including just before the applied voltage is switched and a transient period, a conductive connection state between the power source and the display electrode can be a low impedance state. Since current flows corresponding to the situation so that the applied voltage varies as being set, a constant light emission efficiency can be obtained regardless of the number of cells to be lighted that depends on the content of the display.

FIG. 1 shows a drive voltage waveform and a discharge current waveform for display discharge according to the present invention. A waveform of a pulse related to display discharge of one time has a step-like form for applying the offset drive voltage Vso that is a sustain voltage Vs plus an auxiliary voltage Vo to the XY-interelectrode, and for applying a sustain voltage Vs thereafter. In a period To for applying the offset drive voltage Vso, display discharge starts and discharge current starts to flow. The period To is set so that the application of the offset drive voltage Vso is finished before the discharge ends. A period Ts for applying the sustain voltage Vs is necessary for reforming an appropriate quantity of wall charge. The application of the voltage continues for a while after the discharge ends, so that accumulation of the wall charge continues by electrostatic attraction of the space charge. In the application of this waveform, the output port of the driving circuit is made low impedance during the period T1 in FIG. 1 including just before the drop of the applied voltage (i.e., the end of the period To). At the end of the period Ts, the output port of the driving circuit is made high impedance.

Hereinafter, an importance of making the driving circuit low impedance will be explained more in detail. When the applied voltage is switched, usually in the transition period of switching, the driving circuit is temporarily separated from a load so that the output port thereof becomes high impedance. In the high impedance state, the current supply by the power source and current sinking are stopped, and the output terminal of the driving circuit becomes high impedance during display discharge, then the discharge is weaken and the display becomes dark. Even if current from the power source stops, current to some extent is supplied by capacitance between display electrodes. However, if the number of cells in which discharge is generated is large, supplied current quantity for one cell becomes very little, so that large drop of luminance cannot be avoided. This problem can be solved by making the output of the driving circuit low impedance.

Furthermore, in the present invention, the timing when the applied voltage is switched from the offset drive voltage Vso to the sustain voltage Vs is changed in accordance with a load of the display. Usually, there is a variation of discharge characteristics between cells of the plasma display panel, so discharge is not started completely at the same time even if the same drive voltage is applied to all cells. The larger the number of lighted cells is (The larger the load factor of the display is), the wider the range of the discharge start time is. In addition, the larger the number of lighted cells, the later the start time and the end time of the discharge can be because of drop of the drive voltage or insufficient drive current due to influence of electrode resistance and inner resistance of the driving circuit. Namely, an optimal time of switching the voltage from the offset drive voltage Vso to the sustain voltage Vs is not constant but depends on the display load. Therefore, variation of luminance and light emission efficiency can be reduced by adjusting the time of changing the voltage in accordance with the variation of the display load.

DESCRIPTION OF THE PREFERRED EMBODIMENTS

Hereinafter, the present invention will be explained more in detail with reference to embodiments and drawings.

Figure 2:
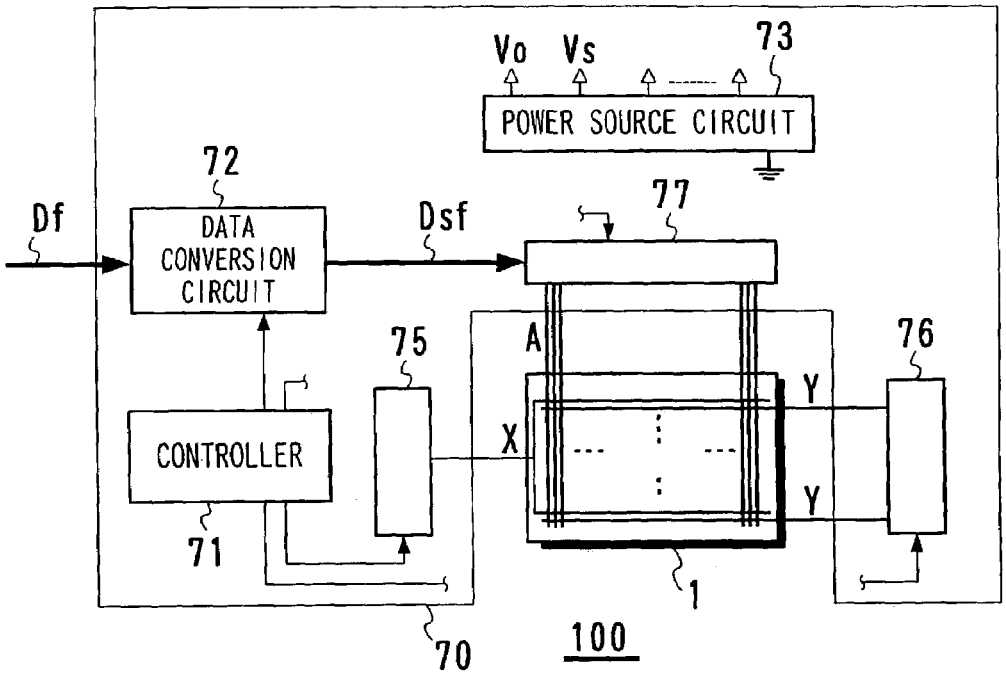
FIG. 2 is a block diagram of a display device according to the present invention.
Figure 3:
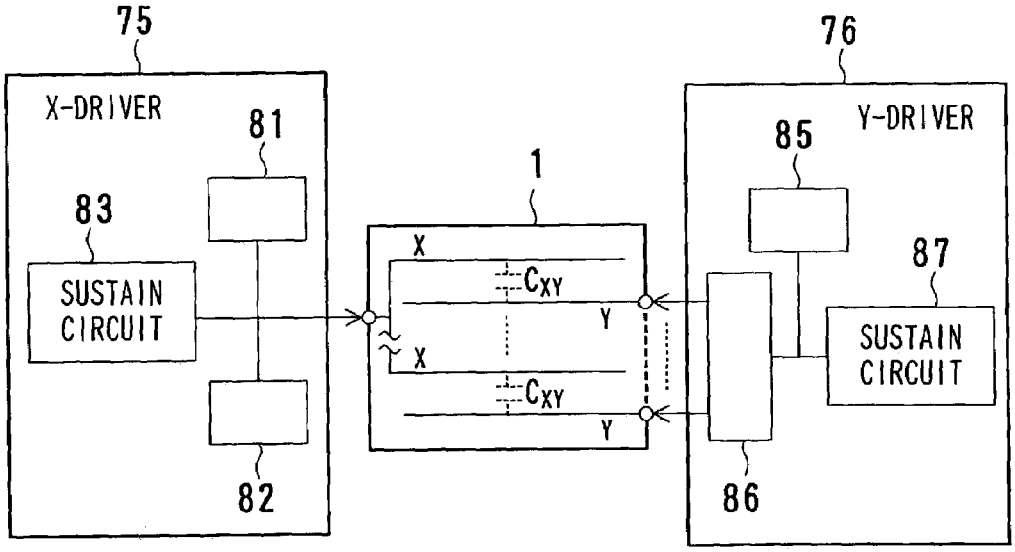
FIG. 3 is a schematic block diagram of an X-driver and a Y-driver for driving display electrodes.

FIG. 2 is a block diagram of a display device according to the present invention, and FIG. 3 is a schematic block diagram of an X-driver and a Y-driver for driving display electrodes. A display device 100 includes a surface discharge type PDP 1 having a color display screen and a drive unit 70 for controlling light emission of cells, and is used as a wall-hung television set or a monitor of a computer system.

In the PDP 1, a display electrode X and a display electrode Y are arranged in parallel to make an electrode pair for generating display discharge, and address electrodes A are arranged so as to cross the display electrodes X and Y. The display electrodes X and Y extend in the row direction (the horizontal direction) of a screen, and the address electrodes extend in the column direction (the vertical direction).

The drive unit 70 includes a controller 71, a data conversion circuit 72, a power source circuit 73, an X-driver 75, a Y-driver 76 and an A-driver 77. The drive unit 70 is supplied with frame data Df that indicate luminance level of red, green and blue colors together with various synchronizing signals from an external device such as a TV tuner or a computer. The frame data Df are stored in a frame memory of the data conversion circuit 72 temporarily. The data conversion circuit 72 converts the frame data Df into subframe data Dsf for a gradation display and sends them to the A-driver 77. The subframe data Dsf are a set of display data of one bit per cell, and a value of each bit indicates whether light emission of a corresponding cell of one subframe is necessary or not, more specifically whether address discharge is necessary or not. The A-driver 77 applies an address pulse to the address electrode A that passes through the cell that is to generate address discharge in accordance with the subframe data Dsf. The application of a pulse to an electrode means to bias the electrode temporarily to a predetermined potential. The controller 71 controls the application of the pulse and transmission of the subframe data Dsf. The power source circuit 73 supplies a power necessary for driving the PDP 1 to each driver.

As shown in FIG. 3, the X-driver 75 includes a reset circuit 81 for applying a pulse for initialization of wall charge to the display electrode X, a bias circuit 82 for controlling a potential of the display electrode X in an addressing process and a sustain circuit 83 for applying a sustain pulse to the display electrode X. The Y-driver 76 includes a reset circuit 85 for applying a pulse for initialization of wall charge to the display electrode Y, a scan circuit 86 for applying a scan pulse to the display electrode Y in the addressing process and a sustain circuit 87 for applying a sustain pulse to the display electrode Y.

Figure 4:
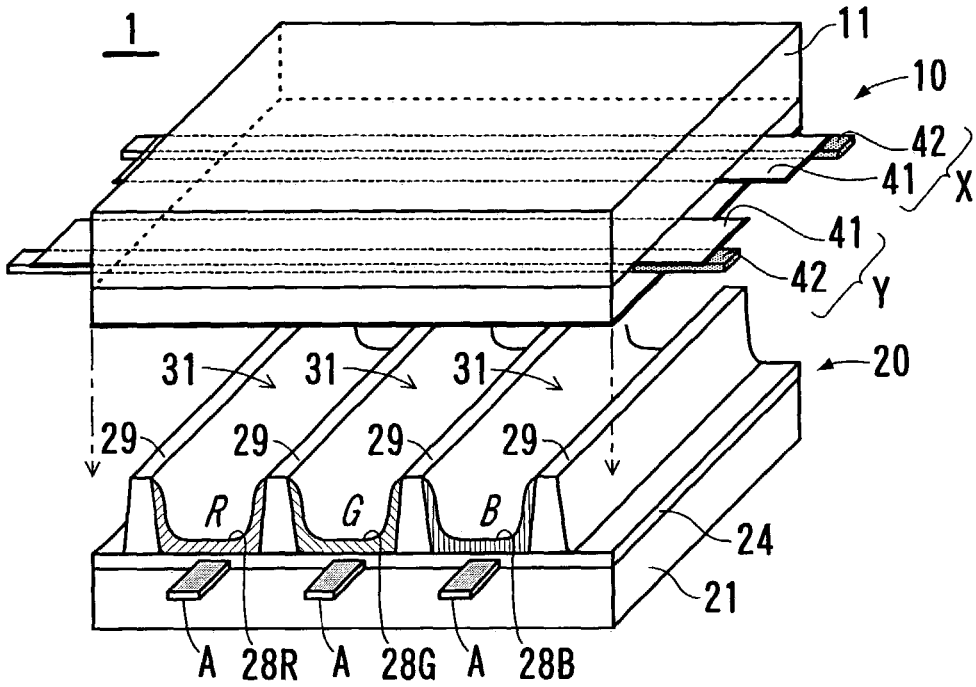
FIG. 4 is a diagram showing a cell structure of a PDP.

FIG. 4 is a diagram showing a cell structure of a PDP. The PDP 1 includes a pair of substrate structural bodies 10 and 20. The substrate structural body means a structural body of a glass substrate on which electrodes and other elements are disposed. In the PDP 1, the display electrodes X and Y, a dielectric layer 17 and a protection film 18 are disposed on the inner surface of the front glass substrate 11, while the address electrodes A, an insulator layer 24, partitions 29 and fluorescent material layers 28R, 28G and 28B are disposed on the inner surface of the back glass substrate 21. Each of the display electrodes X and Y includes a transparent conductive film 41 for forming a surface discharge gap and a metal film 42 as a bus conductor. The partitions 29 are arranged so that each partition 29 corresponds to an electrode gap of an address electrode arrangement, and the partitions 29 divide a discharge space into columns in the row direction. A column space 31 corresponding to each column of the discharge space is continuous over all rows. The fluorescent material layers 28R, 28G and 28B are excited locally by ultraviolet rays emitted by a discharge gas and emit light. The italic letters R, G and B in FIG. 4 indicate light emission colors of the fluorescent material.

Hereinafter, a method for driving the PDP 1 of the display device 100 will be explained.

Figure 5:
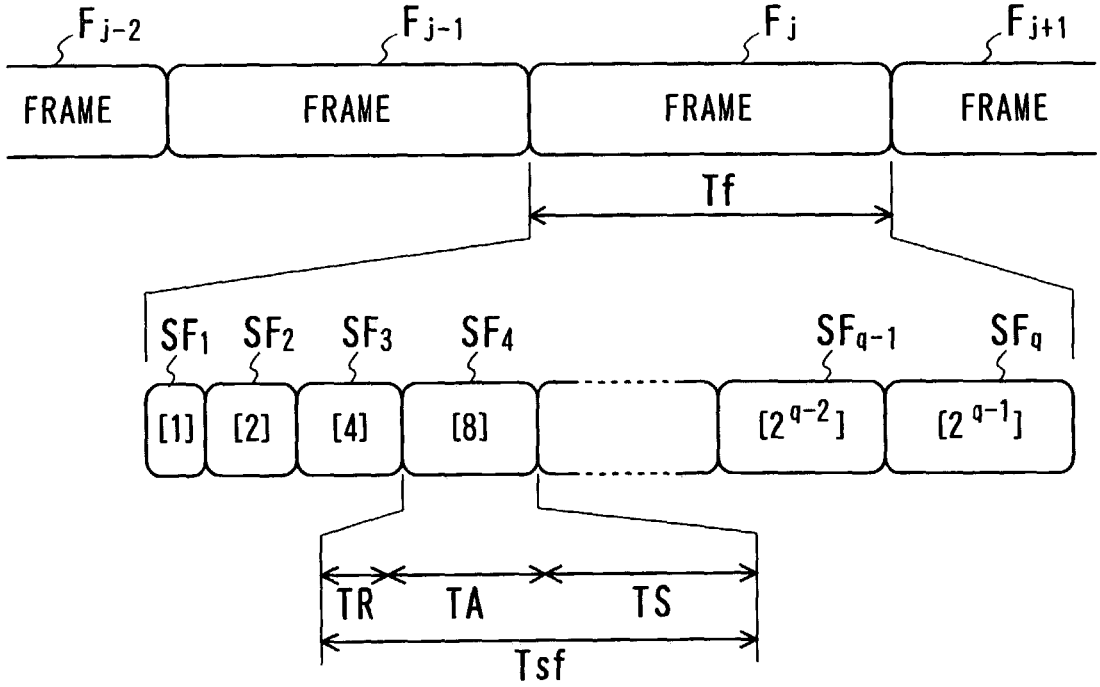
FIG. 5 shows a concept of frame division.

FIG. 5 shows a concept of frame division. In a display by the PDP 1, a binary control of lighting is performed for color reproduction. Therefore, each of sequential frames F of an input image is divided into a predetermined number q of subframes SF. In other words, each frame F is replaced with a set of q subframes SF. These subframes SF are provided with weights, e.g., $2^0$, $2^1$, $2^2$, . . . , $2^{q-1}$ in turn for setting the number of display discharge times of each subframe SF. Though the subframe arrangement is in the order of the weight in FIG. 5, it can be other orders. A redundant weighting can be adopted for reducing a quasi contour. In accordance with such a frame structure, a frame period Tf that is a frame transmission period is divided into q subframe periods Tsf, and each of the subframes SF is assigned to one subframe period Tsf. In addition, the subframe period Tsf is divided into a reset period TR for initialization, an address period TA for addressing and a display period TS for sustaining. The lengths of the reset period TR and the address period TA are constant regardless of the weight. In contrast, the length of the display period TS is longer as the weight is larger. Therefore, the length of the subframe period Tsf is also longer as the weight of the corresponding subframe SF is larger. The driving sequence is repeated in every subframe, and in q subframes SF the order of the reset period TR, the address period TA and the display period TS are the same.

Figure 6:
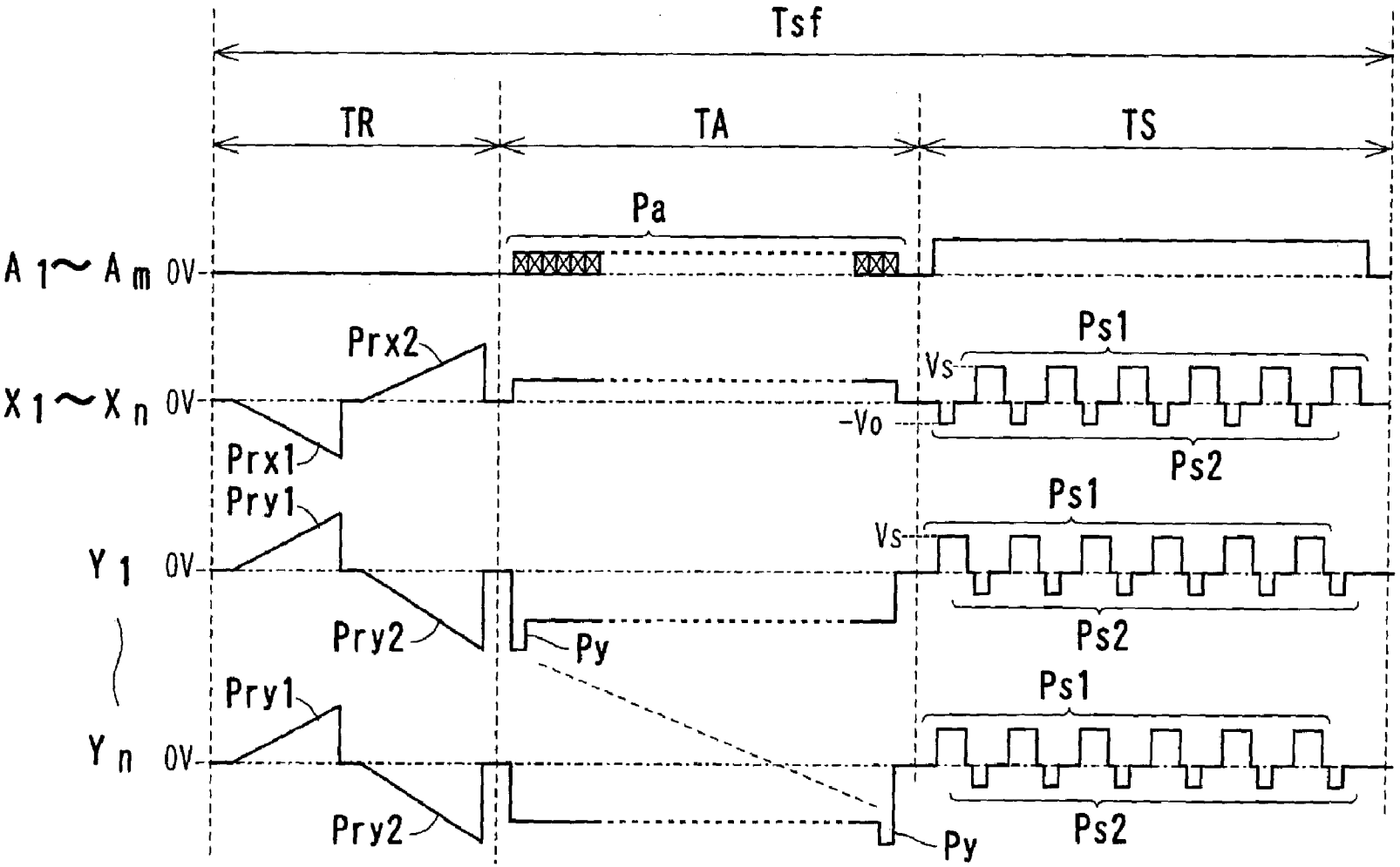
FIG. 6 shows voltage waveforms for a general driving sequence.

FIG. 6 shows voltage waveforms for a general driving sequence. In FIG. 6, suffixes (1, n) of the reference letters of the display electrodes X and Y indicate an arrangement order of a corresponding row, and suffixes (1, m) of the reference letters of the address electrodes A indicate an arrangement order of a corresponding column. The illustrated waveforms are an example. The amplitude, the polarity and the timings thereof can be changed variously.

In the reset period TR of each subframe SF, a pulse Prx1 having the negative polarity and a pulse Prx2 having the positive polarity are applied to all display electrodes X sequentially, and a pulse Pry1 having the positive polarity and a pulse Pry2 having the negative polarity are applied to all display electrodes Y sequentially. The pulses Prx1, Prx2, Pry1 and Pry2 are ramp waveform pulses having increasing amplitude at a rate that enables microdischarge. The pulses Prx1 and Prxy that are applied first are applied to all cells regardless of the state of light or non-light in the previous subframe so that an appropriate wall voltage having the same polarity is generated in the cells. When the pulses Prx2 and Pry2 are applied to the cells having an appropriate wall charge, the wall voltage can be adjusted to a value that corresponds to the difference between a discharge start voltage and pulse amplitude in accordance with the values of the pulses Prx2 and Pry2. The initialization (an equalization of charge) in this example is to set wall charge (i.e., wall voltage) of every cell to a specific value. It is possible to perform the initialization by applying the pulse either to the display electrode X or to the display electrode Y. However, as shown in FIG. 6 by applying the pulses having opposite polarities to both the display electrode X and the display electrode Y as shown in FIG. 6, reduction of a withstand voltage of a driver circuit element can be achieved. The drive voltage that is applied to the cell is a composite voltage that is a sum of two amplitudes of pulses applied to the display electrodes X and Y.

In the address period TA, the wall charge that is necessary for the sustaining process is formed only in cells to be lighted. In the state where all the display electrodes X and all the display electrodes Y are biased to a predetermined potential, the scan pulse Py having the negative polarity is applied to one display electrode Y corresponding to a selected row for each row selection period (a scan time of one row). The address pulse Pa is applied only to the address electrode A that corresponds to the selected cell in which address discharge is to be generated at the same time as the row selection. Namely, the potential of the address electrode A is controlled in a binary manner in accordance with subframe data Dsf of m columns in the selected row. In the selected cell, discharge is generated between the display electrode Y and the address electrode A, and the discharge causes surface discharge between the display electrodes. The sequential set of discharge is the address discharge.

Figure 1:
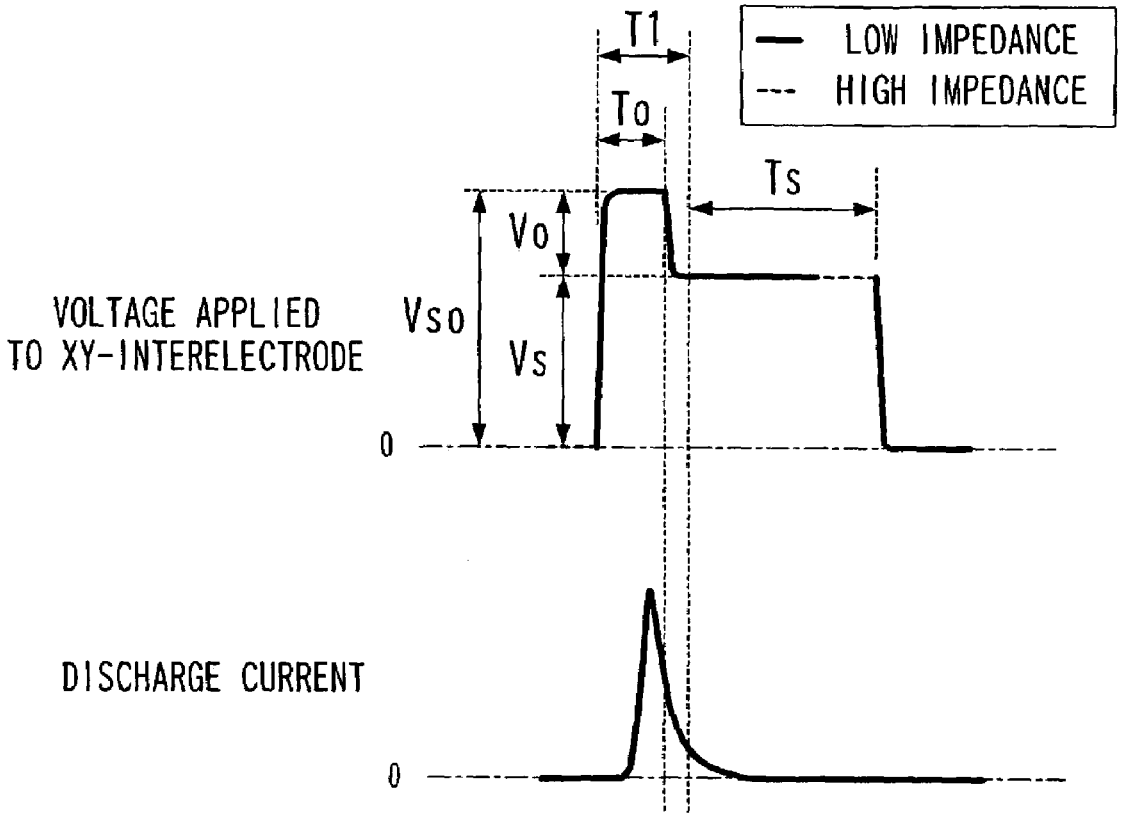
FIG. 1 shows a drive voltage waveform and a discharge current waveform for display discharge according to the present invention.

In the display period TS, a normal pulse Ps1 having an amplitude Vs and the positive polarity is applied to all the display electrodes Y first, and simultaneously an auxiliary pulse Ps2 having an amplitude Vo and the negative polarity is applied to all the display electrodes X. The pulse width of the auxiliary pulse Ps2 is shorter than the pulse width of the normal pulse Ps1. By applying the normal pulse Ps1 and the auxiliary pulse Ps2, a sustain pulse having a step-like waveform as shown in FIG. 1 is applied to the display electrode pair (i.e., the XY-interelectrode). After that, the normal pulse Ps1 and the auxiliary pulse Ps2 are applied to the display electrode X and the display electrode Y alternately. Thus, a sustain pulse train having alternating polarities is applied to the XY-interelectrode. When the sustain pulse is applied, surface discharge is generated in the cell having a predetermined wall charge remained. The number of application of the sustain pulse corresponds to the weight of the subframe as explained above. In order to prevent undesired discharge, the address electrode A can be biased in the same polarity as the normal pulse Ps1 during the display period TS.

Among the above-mentioned driving sequence, the application of the sustain pulse in the display period TS is significantly related to the present invention. Hereinafter, a structure and an operation of the sustain circuit 83 (see FIG. 3) will be explained, which is means for applying the sustain pulse to the display electrode X. Concerning the sustain circuit 87 that is means for applying the sustain pulse to the display electrode Y, explanation of a structure and an operation thereof is omitted since they are similar to those of the sustain circuit 83.

[First Embodiment of Generating the Sustain Pulse]

Figure 7:
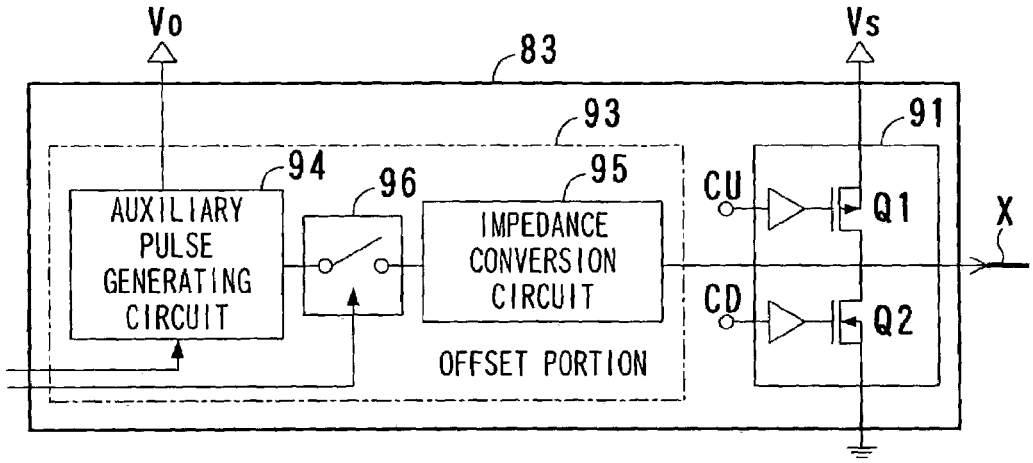
FIG. 7 shows a first example of a sustain circuit structure.

FIG. 7 shows a first example of a sustain circuit structure. The sustain circuit 83 includes a normal pulse generating circuit 91 having a function of outputting a rectangular pulse having the amplitude Vs and an offset portion 93 that outputs a rectangular pulse having the amplitude Vo for generating the above-mentioned step-like sustain pulse Ps.

The normal pulse generating circuit 91 is a switching circuit with a push-pull structure having a pair of switching elements Q1 and Q2, and connects the display electrode X to a power source terminal of the potential Vs or to the GND. The potential Vs means a potential having a potential difference Vs to the GND potential. The switching elements Q1 and Q2 in this example are field effect transistors, and the gates thereof are supplied with control signals CU and CD from the controller 71 shown in FIG. 2 via a gate driver.

The offset portion 93 includes an auxiliary pulse generating circuit 94 for generating a rectangular pulse having the amplitude Vo, an impedance conversion circuit 95 for reducing an output impedance of the auxiliary pulse generating circuit 94 to the display electrode X and a switch circuit 96 for opening or closing the conductive path between the auxiliary pulse generating circuit 94 and the impedance conversion circuit 95. By providing the impedance conversion circuit 95, even if the number of lighted cells is different between subframes and thereby discharge current quantity is different in the entire display screen, the sustain pulse Ps having a regular waveform determined by the control timing of the normal pulse generating circuit 91 and the auxiliary pulse generating circuit 94 can be applied to the display electrode X. This impedance conversion circuit 95 is constituted so that the output impedance thereof becomes high (off state) when the switch circuit 96 opens. Except for the period T1 shown in FIG. 1, the impedance conversion circuit 95 is set to the off state. It is for preventing the impedance conversion circuit 95 from being a load to other circuits (such as the reset circuit 81 and the bias circuit 82) that are connected to the display electrode X.

Figure 8A:
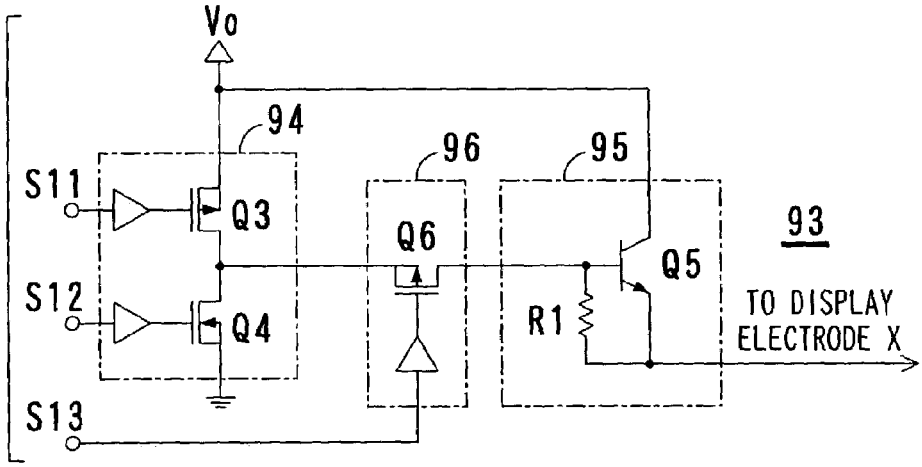
FIGS. 8A and 8B are circuit diagrams of an offset portion according to a first embodiment.
Figure 8B:
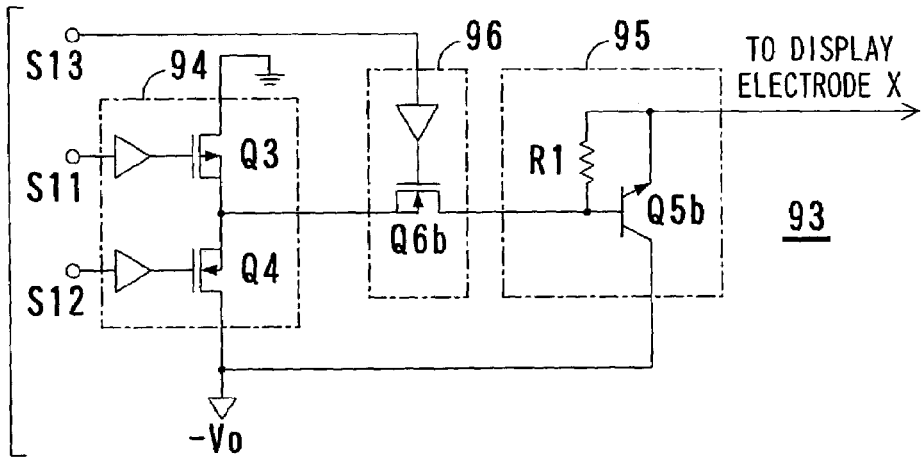

FIGS. 8A and 8B are circuit diagrams of an offset portion according to a first embodiment. FIG. 8A shows a circuit structure in the case of the positive voltage output, and FIG. 8B shows a circuit structure in the case of the negative voltage output.

In FIG. 8A, the auxiliary pulse generating circuit 94 is a switching circuit with a push-pull structure having a pair of switching elements Q3 and Q4 and connects the output terminal of the circuit to the power source terminal of the potential Vo or to the ground. The switching elements Q3 and Q4 in this example are field effect transistors, and the gates thereof are supplied with the control signals S11 and S12 from the controller 71 shown in FIG. 2 via the gate driver. The impedance conversion circuit 95 is an emitter follower including an NPN transistor Q5. The emitter follower has a characteristic that it is normally active including the case where there is no input signal, and the output terminal thereof has a low impedance to alternate current. In other words, it is considered that the output terminal is connected to the ground via a capacitor having infinite capacitance. In this example, a resistor R1 is connected between the base and the emitter of the transistor Q5. Therefore, when the switch circuit 96 cuts off the base input to the transistor Q5, potential difference between the base and the emitter is kept to 0 volt, and the transistor Q5 is turned off completely. In this state, from-the output terminal the impedance conversion circuit 95 is observed to have very small capacitance of approximately 100 picofarads. If the resistance of the resistor R1 is too small, the pulse waveform has a distortion. In contrast, if it is too large, the off state of the transistor Q5 becomes unstable. If the transistor Q5 is a bipolar transistor as the illustrated example, an output waveform and an operation that have no problem practically can be obtained under the condition where the resistance of the resistor R1 is a value within the range from a few kilohms to a hundred and a few tens of kilohms. The switch element Q6 that constitutes the switch circuit 96 is a P-channel MOS type field effect transistor, and the gate thereof is supplied with a control signal S13 from the controller 71 via the gate driver.

The circuit structure shown in FIG. 8B is basically the same as that shown in FIG. 8A. In FIG. 8B, the impedance conversion circuit 95 is an emitter follower including a PNP type transistor Q5*b*, and the switch element Q6*b* that constitutes the switch circuit 96 is an N-channel MOS type field effect transistor.

Figure 9:
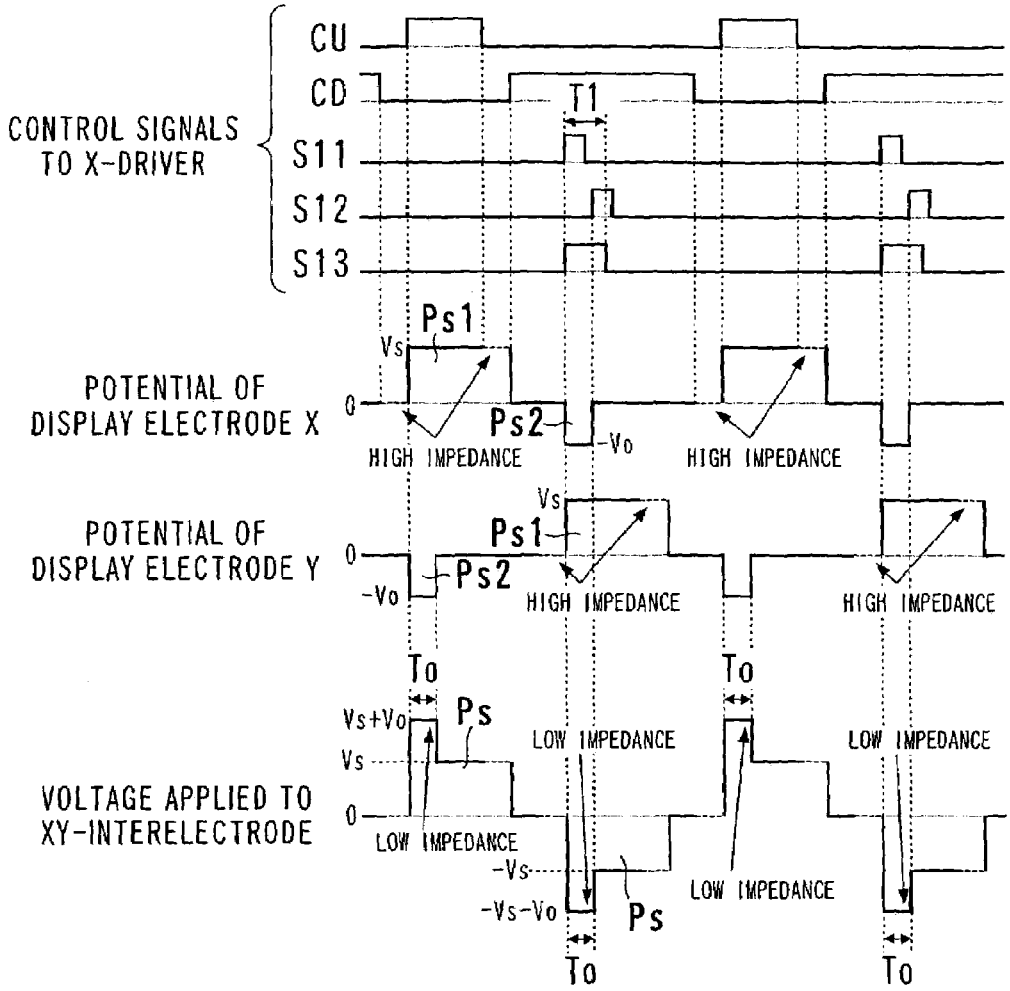
FIG. 9 shows waveforms for drive control according to the first embodiment.

FIG. 9 shows waveforms for drive control according to the first embodiment. The illustrated example is an example where the sustain pulse Ps is applied by the X-driver 75 and the Y-driver 76 including the offset portion 93 that has a negative voltage output structure as shown in FIG. 8B. In FIG. 9, timings of control signals CU, CD, S11, S12 and S13 to the X-driver 75 are indicated, while timings of control signals CU, CD, S11, S12 and S13 to the Y-driver 76 are omitted. The waveforms of the control signals to the Y-driver 76 are shifted from the waveforms of the control signals to the X-driver 75 by one period for applying the sustain pulse.

The application start (the leading edge) of the normal pulse Ps1 to the display electrode pair responds to turning on of the control signal CU, and the application end (the trailing edge) thereof responds to turning on of the control signal CD. One of the control signal CU and the control signal CD is turned on after the other is turned off and after the dead time. During the dead time, the drive output to the display electrode pair is in the high impedance state. The application start of the auxiliary pulse Ps2 to the display electrode pair corresponds to turning on of the control signal S11, and the application end thereof corresponds to turning on of the control signal S12. As explained above, when the normal pulse Ps1 is applied to one of the display electrode X and the display electrode Y, at the same time, the auxiliary pulse Ps2 is applied to the other, so that the sustain pulse Ps having a step-like waveform as shown in FIG. 9 is added to the XY-interelectrode. In this example, from the leading edge of the sustain pulse Ps to just before the trailing edge, i.e., the start of the dead time, a drive output to the display electrode pair is in the low impedance state. The period of the low impedance state includes the period T1 that is the sum of the period To for applying the auxiliary pulse Ps2 and a transition period for changing voltage just after the period To. The control signal S13 is turned on only during the period T1, and the auxiliary pulse Ps2 is outputted to the display electrode pair.

Figure 10A:
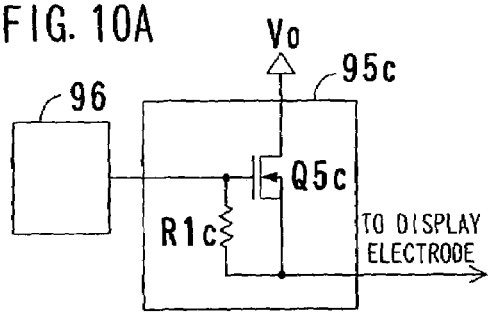
FIGS. 10A and 10B show variations of an impedance conversion circuit.
Figure 10B:
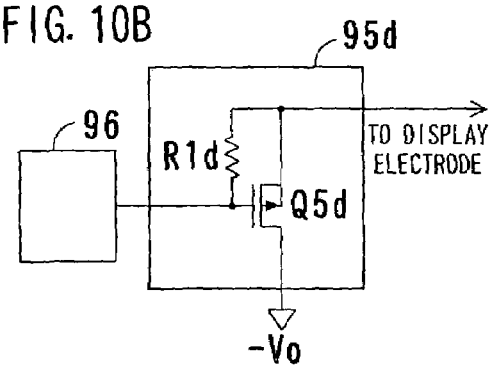

FIGS. 10A and 10B show variations of an impedance conversion circuit. FIG. 10A shows a circuit structure in the case of a positive voltage output, and FIG. 10B shows a circuit structure in the case of a negative voltage output. In the variations shown in FIGS. 10A and 10B, the impedance conversion circuits 95*c* and 95*d* are source followers including a field effect transistor Q5*c* or Q5*d*. When this is adopted, a pulse wave having a constant shape can be outputted to the display electrode regardless of a value of the output current. In the above-mentioned emitter follower shown in FIG. 8, there is a problem that an output waveform can be distorted when base current flows. This problem is solved by using a field effect transistor that is an element controlled by voltage. Furthermore, since the input impedance between the gate and the source of a field effect transistor is very high compared with the input impedance between the base and the emitter of the bipolar transistor, resistance values of the resistors R1*c* and R1*d* for keeping the impedance conversion circuits 95*c* and 95*d* in the off state during the control signal (the gate input) is not inputted can be large values within the range from a few hundreds of kilohms to a few tens of megohms. The field effect transistors Q5*c* and Q5*d* can be a MOS type or a junction type. Instead of the field effect transistor, other voltage-controlled elements such as an insulated gate bipolar transistor (IGBT) can be used. However, when using a MOS type field effect transistor, there is a parasitic diode that is conductive in the direction opposite to the conducting direction of the element between the source and drain. In order to prevent needless current from flowing when the electrode potential becomes higher than the power source potential due to an unexpected reason, it is desirable to insert a diode for preventing reverse current at an appropriate place in the sustain circuit.

Other variations include an emitter follower made of a plurality of transistors that have Darlington connections. According to this, the influence of the input current is small compared with the emitter follower made of a single transistor, so distortion of the pulse wave to load current is small.

[Second Embodiment of Generating the Sustain Pulse]

Figure 11:
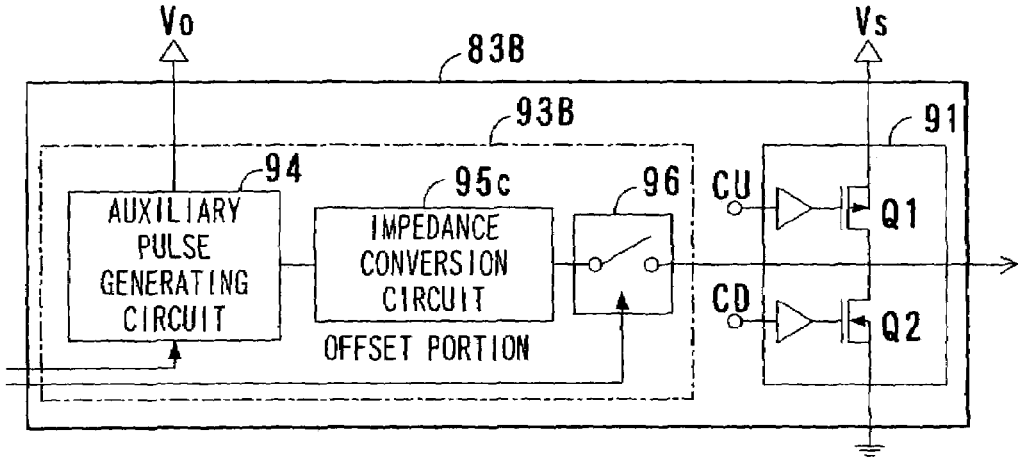
FIG. 11 shows a second example of a sustain circuit structure.
Figure 12:
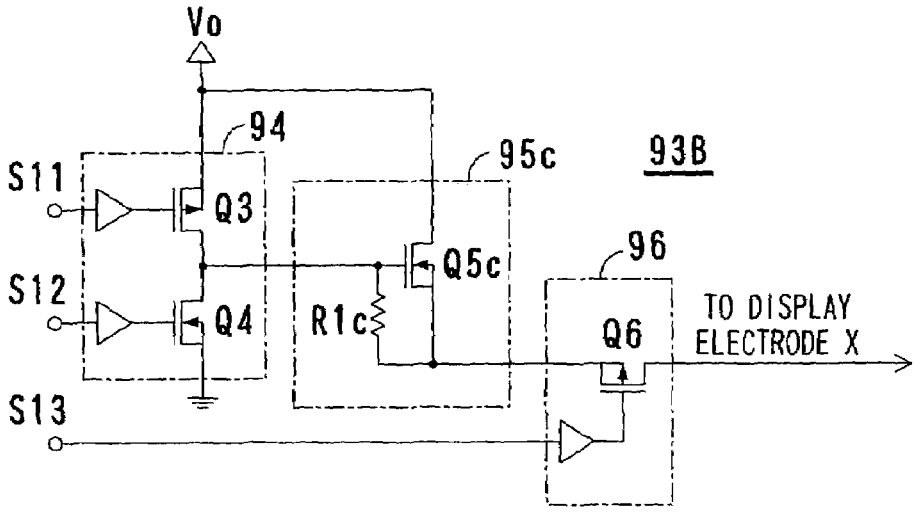
FIG. 12 is a circuit diagram of an offset portion according to a second embodiment.

FIG. 11 shows a second example of the sustain circuit structure, and FIG. 12 is a circuit diagram of the offset portion according to a second embodiment. In FIGS. 11 and 12, the same elements as in the first embodiment are denoted by the same reference letters as in the first embodiment, and the explanations thereof are omitted or simplified. This policy is applied to all figures that will be explained below.

The sustain circuit 83B includes a normal pulse generating circuit 91 and an offset portion 93B that outputs an auxiliary pulse having the amplitude Vo. The normal pulse generating circuit 91 is a switching circuit having a push-pull structure made of a pair of switching elements Q1 and Q2. The offset portion 93B includes an auxiliary pulse generating circuit 94, an impedance conversion circuit 95*c* and a switch circuit 96 for-opening or closing the conductive path between the impedance conversion circuit 95*c* and the display electrode X. Since the impedance conversion circuit 95*c* is provided, the number of lighted cells is different between the subframes. Therefore, even if the discharge current quantity of the entire display screen is different, a sustain pulse having a waveform that is faithful to design in accordance with the control timing of the normal pulse generating circuit 91 and the auxiliary pulse generating circuit 94 can be applied to the display electrode X. The switch circuit 96 separates the impedance conversion circuit 95*c* from the display electrode X except the period Ti shown in FIG. 1, so as to prevent the impedance conversion circuit 95*c* from being a load to other circuits connected to the display electrode X.

[Third Embodiment of Generating the Sustain Pulse]

Figure 13:
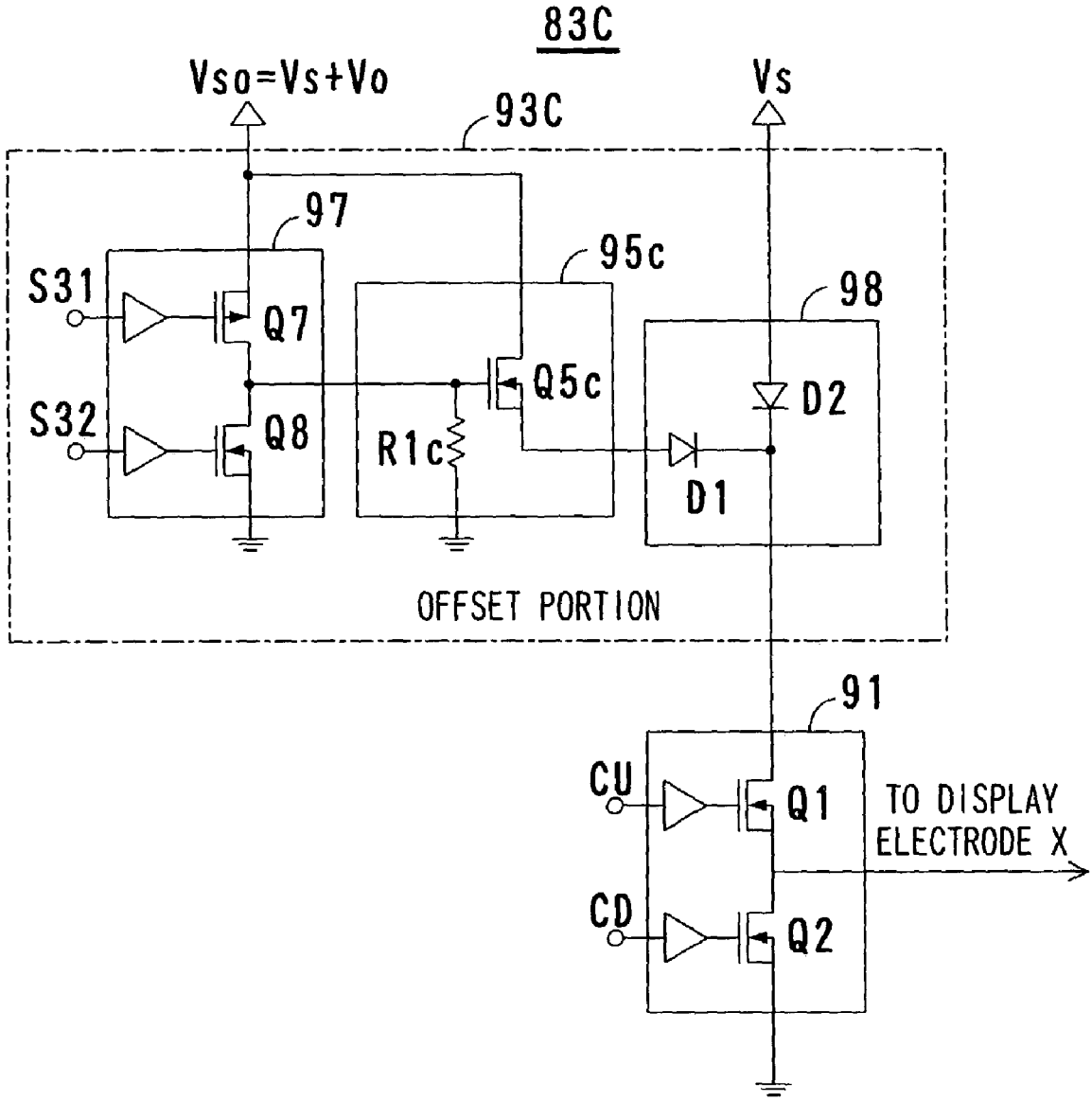
FIG. 13 is a circuit diagram showing a third example of a sustain circuit structure.

FIG. 13 is a circuit diagram showing a third example of a sustain circuit structure. In the illustrated structure, a sustain pulse having the positive polarity is outputted. However, by changing the polarity of the element, a circuit for outputting a sustain pulse having the negative polarity can be constituted. The sustain circuit 83C includes a normal pulse generating circuit 91 and an offset portion 93C for outputting an offset drive pulse having the amplitude Vso (=Vs+Vo). The normal pulse generating circuit 91 is a switching circuit having a push-pull structure made of a pair of switching elements Q1 and Q2. The offset portion 93C includes an offset drive pulse generating circuit 97 for generating an offset drive pulse, an impedance conversion circuit 95*c* for reducing an output impedance of the offset drive pulse generating circuit 97 to the display electrode X and a backflow prevention circuit 98 including two diodes D1 and D2. The offset drive pulse generating circuit 97 is a switching circuit having a push-pull structure made of a pair of switching elements Q7 and Q8, and the output terminal of the circuit is connected to the power source terminal of the potential Vso or the GND terminal. The switching elements Q7 and Q8 in this example are field effect transistors, and the gates thereof are supplied with control signals S31 and S32 from the controller 71 shown in FIG. 2 via the gate driver. Since the impedance conversion circuit 95*c* is provided, the number of lighted cells is different between subframes. Therefore, even if the discharge current quantity of the entire display screen is different, a sustain pulse having a waveform that is faithful to the design in accordance with the control timings of the normal pulse generating circuit 91 and the offset drive pulse generating circuit 97 can be applied to the display electrode X. In the backflow prevention circuit 98, the diode D1 is inserted between the impedance conversion circuit 95*c* and the normal pulse generating circuit 91 so that a forward direction electric path is formed. The diode D2 is inserted between the power source terminal of the potential Vs and the normal pulse generating circuit 91 so that the forward direction electric path is formed.

Figure 14:
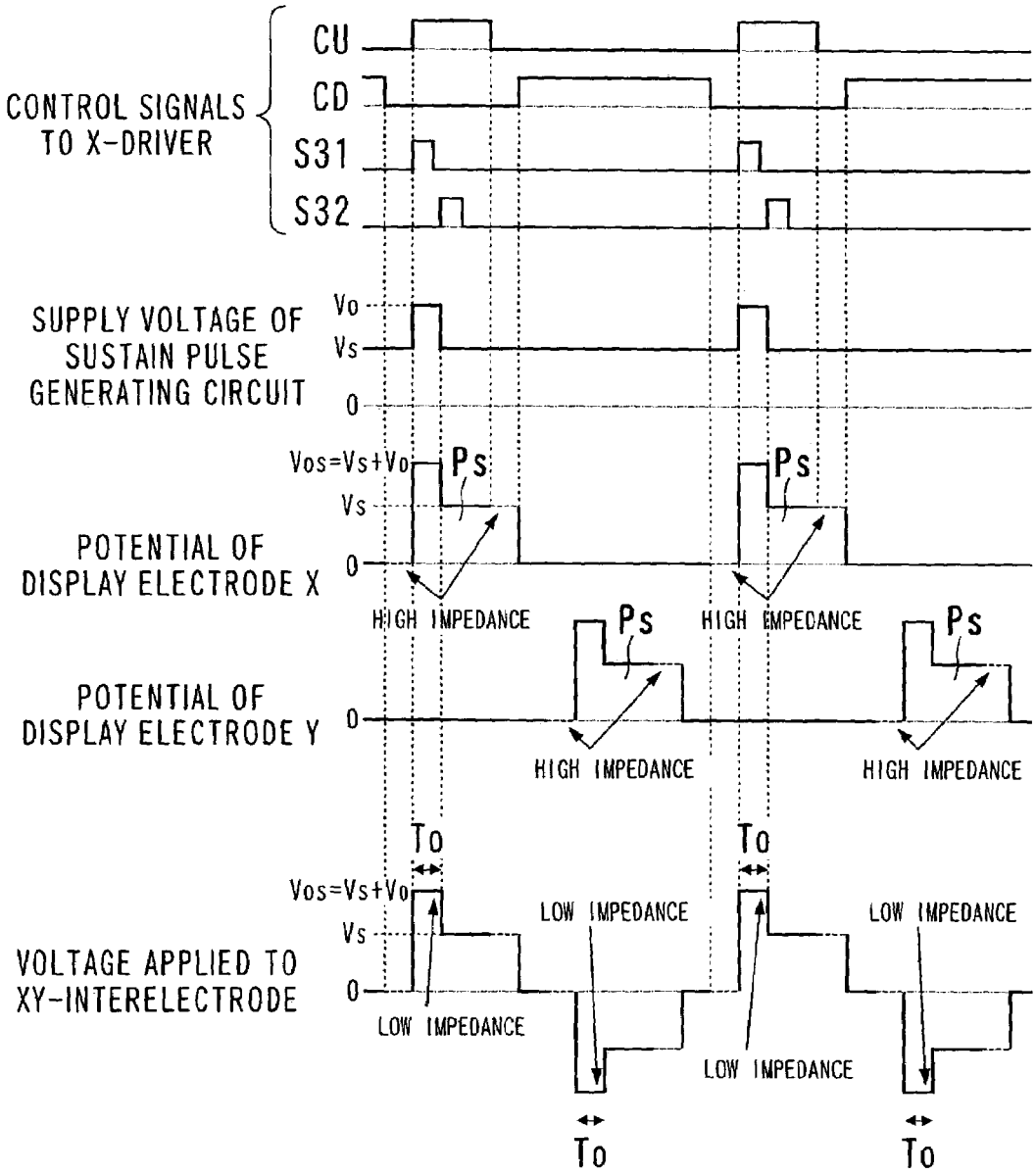
FIG. 14 shows waveforms for drive control according to a third embodiment.

FIG. 14 shows waveforms for drive control according to the third embodiment. In FIG. 14, timings of control signal CU, CD, S31 and S32 to the X-driver 75 are shown, but timings of control signals CU, CD, S31 and S32 to the Y-driver 76 are omitted. The waveform of the each control signal to the Y-driver 76 is shifted from the waveform of each control signal to the X-driver 75 by one period for applying the sustain pulse.

The application of the voltage Vs to the display electrode pair starts in response to turning on of the control signal CD. Simultaneously, the application of the voltage Vso (=Vs+Vo) also starts in response to turning on of the control signal S31. As a result, the higher voltage Vso is applied to the display electrode pair. The application of the voltage Vso is finished responding to turning on of the control signal S32 after the time To passes. After that, the application of the voltage Vs continues during a constant period and is finished responding to turning on of the control signal CD. In this way, the sustain pulse Ps having a step-like waveform is applied to the XY-interelectrode. One of the control signal CU and the control signal CD is turned on after the other is turned off and when the dead time passes. During the dead time, the drive output to the display electrode pair is in the high impedance state. During the period from the leading edge of the sustain pulse Ps to just before the trailing edge that is the start of the dead time, the drive output to the display electrode pair is in the low impedance state. The period of the low impedance state includes the period T1 that is the sum of the period To for applying the auxiliary pulse Ps2 and the transition period for changing the voltage thereafter.

[Adjustment of the Drive Waveform]

In order to obtain good luminance and light emission efficiency regardless of the display load in the above-explained first through third embodiments, it is preferable to adjust the timing of changing the voltage in the sustain pulse Ps one after another in accordance with a change of the display load. Hereinafter, the timing adjustment of the sustain pulse Ps will be explained.

Figure 15:
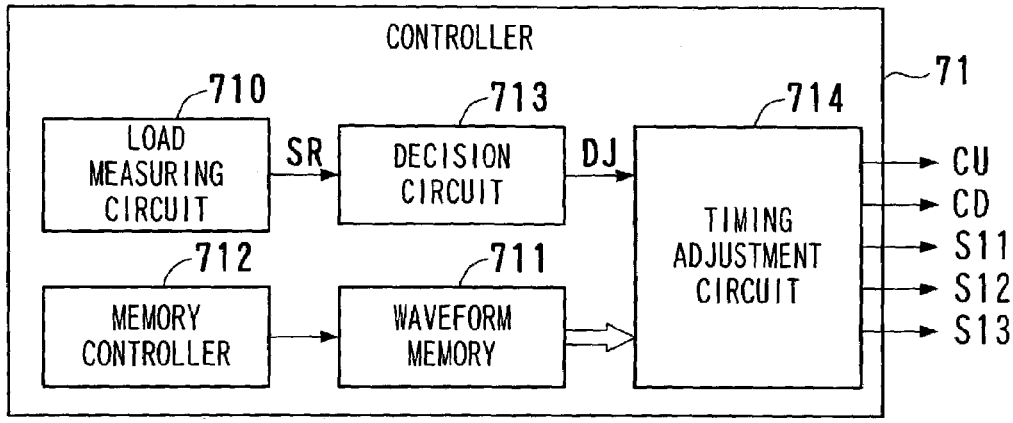
FIG. 15 is a block diagram of a controller.

FIG. 15 is a block diagram of a controller. The controller 71 includes a load measuring circuit 710 that measures a display load in a predetermined period, a waveform memory 711 for memorizing plural types of control signal waveforms, a memory controller 712 for controlling readout of the control signal waveform, a decision circuit 713 for deciding a display load in accordance with a measurement signal SR from the load measuring circuit 710 and a timing adjustment circuit 714 for selecting an optimal control signal waveform in accordance with the output DJ of the decision circuit 713. The control signals CU, CD, S11, S12 and S13, to which the waveform selected by the timing adjustment circuit 714 is applied, are given to the X-driver 75 and the Y-driver.76.

Figure 16:
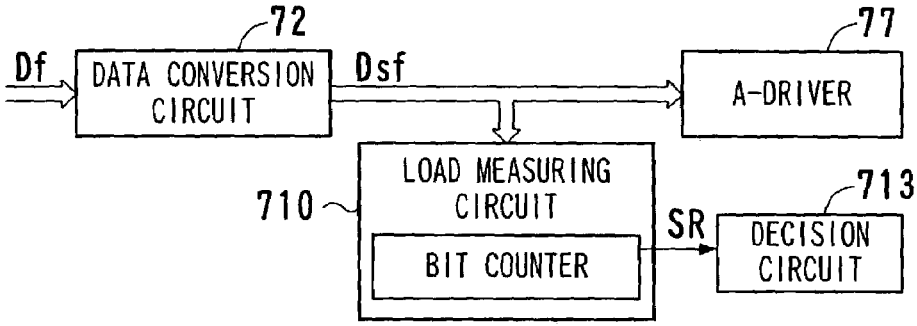
FIG. 16 shows a first example of a load measuring circuit structure.
Figure 17:
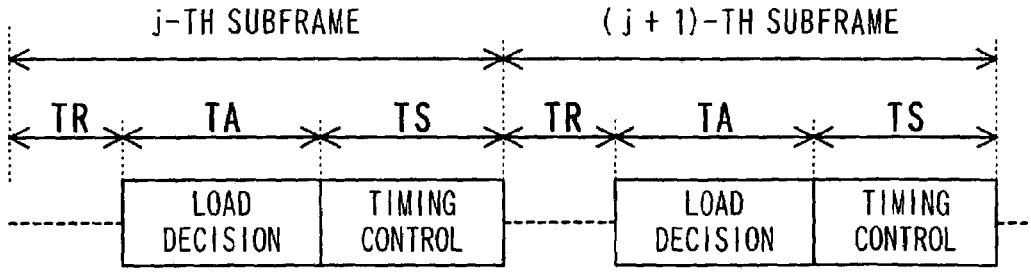
FIG. 17 shows operational timings of a controller having the load measuring circuit of the first example.

FIG. 16 shows a first example of the load measuring circuit structure, and FIG. 17 shows operational timings of a controller having the load measuring circuit of the first example. The load measuring circuit 710 shown in FIG. 16 includes a bit counter and counts the number of lighted cells after getting the subframe data Dsf from the data conversion circuit 72. The decision circuit 713 compares the number of lighted cells given by the measurement signal SR with a predetermined threshold level so as to decide the display load. By adopting the structure of the first example, the display load can be measured correctly.

As shown in FIG. 17, the controller 71 counts the number of lighted cells during the address period TA of the j-th subframe for preparing drive control during the display period TS of the j-th subframe, and selects the best signal waveform by deciding the display load. By adjusting precisely the position of the trailing edge of the period To in accordance with the display load ratio, predetermined luminance and light emission efficiency can be maintained. The quantity of the fine adjustment of the timing may be determined by obtaining the point where the luminance and the light emission efficiency become the maximum values in an experiment. Since the load is counted at the same time when the subframe data Dsf are transferred to the A-driver 77 in the circuit structure shown in FIG. 16, the load decision is done promptly after finishing the load count at the end of the address period TA, and the timing control setting of the display period TS just after that is performed. In contrast, another structure is possible though it is not illustrated. It is the structure in which the data conversion circuit 72 has a frame memory and performs data conversion of all subframes for one frame image in advance, all subframe data Dsf are memorized temporarily in the frame memory, and in the next frame the subframe data Dsf of the previous frame are transmitted to the A-driver 77. In this structure, the load count is performed when memorizing all subframe data Dsf. In this way, the load decision result of all subframes can be obtained in advance. Thus, even if the display period TS begins just after the end of the address period TA, the timing control can be set with sufficient lead time.

Figure 18:
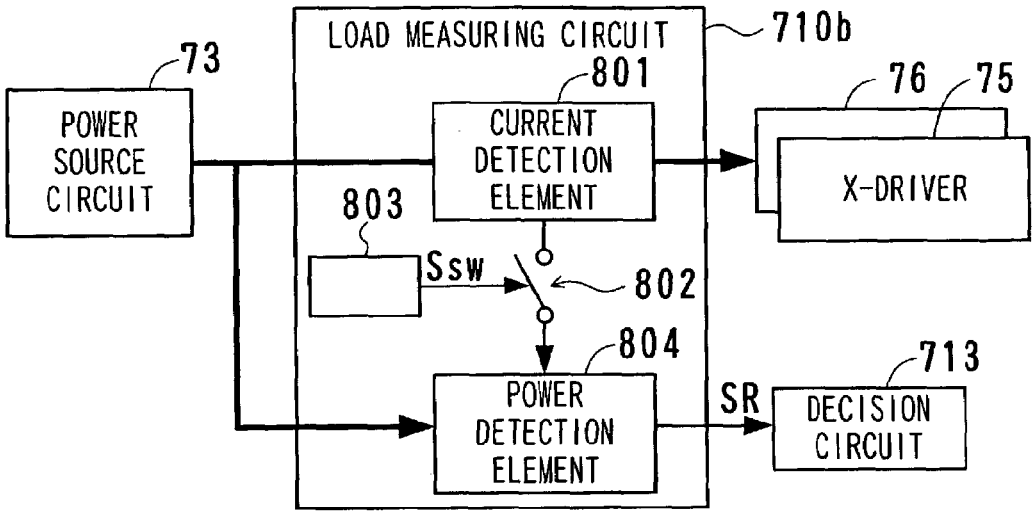
FIG. 18 shows a second example of a load measuring circuit structure.
Figure 19:
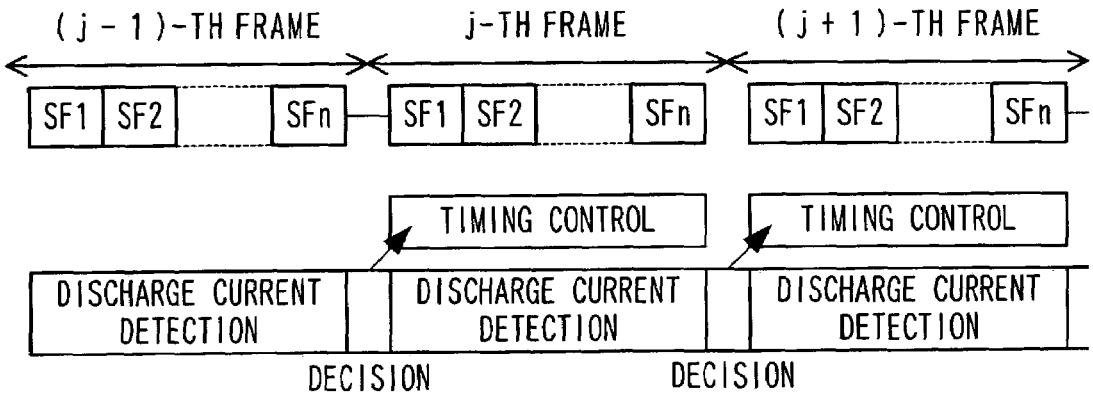
FIG. 19 shows operational timings of a controller having the load measuring circuit of the second example.

FIG. 18 shows a second example of the load measuring circuit structure, and FIG. 19 shows operational timings of a controller having the load measuring circuit of the second example. The load measuring circuit 710*b* shown in FIG. 18 includes a current detection element 801, a switching element 802, a switching controller 803 and a power detection element 804. The current detection element 801 detects current that flows from the power source circuit 73 to the X-driver 75 or the Y-driver 76. During the measuring period while the switching element 802 is in the closed state by the measurement control signal Ssw outputted by the switching controller 803, the detection value of the current detection element 801 is given to the power detection element 804. The power detection element 804 detects average power consumption in the measuring period in accordance with the drive voltage and the detected current value and transmits the signal SR indicating the result to the decision circuit 713.

As shown in FIG. 19, as preparation for control in the display period TS of each subframe of the j-th frame, the controller 71 detects the power consumption in the display period TS of the previous (j−1)th frame so as to decide the display load and to select a signal waveform that is used for the control. As a concept of the selection, the fine adjustment of the timing is performed when it is decided that the power consumption is increasing. If the detected power consumption has a tendency of increase, the timing is delayed or moved up a little. As a result, if the power consumption decreases to some extent, the current timing is maintained. If the power consumption increases more, the timing is delayed or moved up in the direction opposite to the previous time. By repeating this operation, the drive is always performed in the optimal timing, so that the good state of the luminance and the light emission efficiency can be maintained.

For detecting the power consumption, it is possible to obtain an average of plural frames. In addition, means for counting the number of lighted cells mentioned above may be used so that the fine adjustment of the timing is performed in accordance with the comparison between the power consumption that is expected from the display load and the power consumption that is detected actually. In this case, the timing adjustment can be performed that can support a rapid variation of the power consumption per subfield instead of the average variation of the power consumption in plural frames.

In the above-explained embodiment, the circuit example has the GND potential (0 volt) as a reference for positive and negative potentials. However, it is possible to put the reference on a certain positive (+) or negative (−) potential except the GND potential so that a pulse wave voltage having a higher or lower potential is outputted.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A method for driving an AC type plasma display panel in which a voltage pulse train is applied to a display electrode pair so that display discharge is generated plural times in accordance with luminance of image to be displayed, wherein a driving step of one pulse for generating display discharge one time includes the steps of generating display discharge by applying an offset drive voltage that is a sustain voltage plus an auxiliary voltage having the same polarity to the display electrode pair, and applying the sustain voltage for a constant period after dropping the applied voltage from the offset drive voltage to the sustain voltage after generating the display discharge, and a conductive connection state between a power source for supplying an application voltage and the display electrode is a low impedance state that enables current supply from the power source to the display electrode pair at least from the application start of the offset drive voltage until the applied voltage drops to the sustain voltage.

2. The method according to claim 1, wherein an application time of the offset drive voltage is changed in accordance with the number of cells to be lighted in a display of one screen.

3. The method according to claim 1, wherein an application time of the offset drive voltage is changed in accordance with output current of the power source.

4. A device for driving an AC type plasma display panel in which a voltage pulse train is applied to a display electrode pair so that display discharge is generated plural times in accordance with luminance of image to be displayed, the device comprising;

a normal pulse generating circuit for applying a sustain voltage intermittently to the display electrode pair;

an auxiliary pulse generating circuit for applying an auxiliary voltage intermittently to the display electrode pair;

an impedance conversion circuit for reducing an output impedance of the auxiliary pulse generating circuit to the display electrode pair; and a controller for applying the auxiliary voltage during the application of the sustain voltage and for controlling the normal pulse generating circuit and the auxiliary pulse generating circuit so that the application of the sustain voltage continues after stopping the application of the auxiliary voltage for a constant period.

5. The device according to claim 4, further comprising a switch circuit for opening or closing a conductive path between the auxiliary pulse generating circuit and the impedance conversion circuit, wherein the impedance conversion circuit becomes an off state with high output impedance when the conductive path is opened, and the controller controls the switch circuit so that the conductive path is opened except the period for applying the auxiliary voltage.

6. The device according to claim 4, further comprising a switch circuit for controlling conductivity between the impedance conversion circuit and the display electrode pair, wherein the controller controls the switch circuit so that the impedance conversion circuit and the display electrode pair are separated from each other except the period for applying the auxiliary voltage.

7. A device for driving an AC type plasma display panel in which a voltage pulse train is applied to a display electrode pair so that display discharge is generated plural times in accordance with luminance of image to be displayed, the device comprising;

a normal pulse generating circuit for applying a sustain voltage intermittently to the display electrode pair, an offset drive pulse generating circuit for applying an offset drive voltage that is the sustain voltage plus an auxiliary voltage to the display electrode pair intermittently;

an impedance conversion circuit for reducing output impedance of the offset drive pulse generating circuit to the normal pulse generating circuit;

a diode for forming a forward direction electric path between the impedance conversion circuit and the normal pulse generating circuit; and a controller for applying the auxiliary voltage during the application of the sustain voltage and for controlling the normal pulse generating circuit and the offset drive pulse generating circuit so that the application of the sustain voltage continues after stopping the application of the auxiliary voltage for a constant period.

8. The device according to claim 4, further comprising means for counting the number of cells to be lighted in a display of one screen before start of a display period during which the display of one screen is performed, wherein the controller changes the timing of finishing the application of the voltage that is the sustain voltage plus the auxiliary voltage in accordance with the count value of the number of cells to be lighted.

9. The device according to claim 4, further comprising means for measuring power consumption due to display discharge of a frame, wherein the controller changes the timing of finishing the application of the voltage that is the sustain voltage plus the auxiliary voltage in accordance with the measured value of the power consumption for the frame next to the frame in which the power consumption is measured.

* * * * *

UNITED STATES PATENT AND TRADEMARK OFFICE

CERTIFICATE OF CORRECTION

PATENT NO. : 7,023,405 B2
APPLICATION NO. : 10/459610
DATED : April 4, 2006
INVENTOR(S) : Kenji Awamoto et al.

It is certified that error appears in the above-identified patent and that said Letters Patent is hereby corrected as shown below:

First Page Column 2 (U.S. Patent Documents), Line 8, Change "2002/0105484" to --2002/0105485--.

Column 14, Line 19 change "pair," to --pair;--.

Signed and Sealed this

Twenty-eighth Day of November, 2006

JON W. DUDAS
*Director of the United States Patent and Trademark Office*